US011694524B2

(12) United States Patent
Lee et al.

(10) Patent No.: US 11,694,524 B2
(45) Date of Patent: Jul. 4, 2023

(54) CASSETTE AND AUTOMATED TELLER MACHINE INCLUDING THE SAME

(71) Applicant: HYOSUNG TNS INC., Seoul (KR)

(72) Inventors: Jungwhan Lee, Gyeonggi-do (KR); Jun Young Kim, Gyeonggi-do (KR); Chang Ho Park, Gyeonggi-do (KR); Hye Bin Oh, Incheon (KR)

(73) Assignee: HYOSUNG TNS INC., Seoul (KR)

( * ) Notice: Subject to any disclaimer, the term of this patent is extended or adjusted under 35 U.S.C. 154(b) by 0 days.

(21) Appl. No.: 17/089,768

(22) Filed: Nov. 5, 2020

(65) Prior Publication Data

US 2021/0142628 A1 May 13, 2021

(30) Foreign Application Priority Data

Nov. 12, 2019 (KR) ..... 10-2019-0144586

(51) Int. Cl.
*G07D 11/18* (2019.01)
*G07F 19/00* (2006.01)
*G07D 11/13* (2019.01)

(52) U.S. Cl.
CPC ..... *G07F 19/205* (2013.01); *G07D 11/13* (2019.01); *G07D 11/18* (2019.01); *G07F 19/203* (2013.01)

(58) Field of Classification Search
CPC ..... G07F 19/202–205; G07D 11/00; G07D 11/009; G07D 11/13; G07D 11/14;
(Continued)

(56) References Cited

U.S. PATENT DOCUMENTS 7,976,005 B2 * 7/2011 Ichikawa ..... B65H 83/025 271/3.14
9,346,639 B2 * 5/2016 Kim ..... B65H 83/025
(Continued)

FOREIGN PATENT DOCUMENTS

CN 201773438 U 3/2011
CN 105632017 A 6/2016
(Continued)

OTHER PUBLICATIONS

English Translation of CN201773438U, cited by the applicant, publication date Mar. 23, 2011. https://translationportal.epo.org/emtp/translate/?ACTION=description-retrieval&COUNTRY=CN&ENGINE=google&FORMAT=docdb&KIND=U&LOCALE=en_EP&NUMBER=201773438&SRCLANG=zh&TRGLANG=en (Year: 2011).*

(Continued)

*Primary Examiner* — Thien M Le
*Assistant Examiner* — April A Taylor
(74) *Attorney, Agent, or Firm* — Bacon & Thomas, PLLC

(57) ABSTRACT

An automated teller machine includes a cassette, a strongbox protection wall, an external conveyance path, and a plurality of external branch conveyance paths. The cassette includes a plurality of storage parts configured to store a paper medium, and a case having a plurality of entrances through which the paper medium passes to be accumulated in the storage parts or is withdrawn from the storage parts to pass. The strongbox protection wall covers the cassette and has an external entrance through which the paper medium passes to be loaded into the cassette and is unloaded from the cassette to pass. The external conveyance path extending to penetrate the strongbox protection wall through the external entrance. The plurality of external branch conveyance paths
(Continued)

extends between the external conveyance path and the entrances of the case, respectively.

11 Claims, 6 Drawing Sheets

(58) Field of Classification Search
CPC ..... G07D 11/18; G07D 11/237; G07D 11/32; G07D 11/40; G07D 11/60; G07D 2211/00
See application file for complete search history.

(56) References Cited

U.S. PATENT DOCUMENTS

| | | | | |
|---|---|---|---|---|
| 11,222,513 | B2 * | 1/2022 | Ino | E05G 1/024 |
| 2001/0015309 | A1 | 8/2001 | Ikuta | |
| 2006/0169770 | A1 * | 8/2006 | Koshizuka | G07D 11/10 235/381 |
| 2009/0279771 | A1 * | 11/2009 | Stapfer | G06Q 20/042 382/137 |
| 2013/0001040 | A1 | 1/2013 | Iwamura et al. | |
| 2014/0263619 | A1 * | 9/2014 | Turocy | G07D 11/28 235/379 |
| 2015/0021385 | A1 | 1/2015 | Michels et al. | |
| 2015/0100480 | A1 | 4/2015 | Colvin et al. | |
| 2016/0063793 | A1 * | 3/2016 | Nishino | G07D 11/40 194/206 |
| 2016/0335830 | A1 * | 11/2016 | Wakabayashi | B65H 29/62 |
| 2018/0137713 | A1 | 5/2018 | Kuroda et al. | |
| 2018/0197157 | A1 * | 7/2018 | Magee | G06Q 20/1085 |

FOREIGN PATENT DOCUMENTS

| | | | |
|---|---|---|---|
| CN | 105900155 | A | 8/2016 |
| JP | 2013117898 | A | 6/2013 |
| JP | 2014-142845 | A | 8/2014 |
| JP | 62 48405 | B2 | 12/2017 |
| KR | 10-1665609 | B1 | 10/2016 |
| WO | 2018145592 | A1 | 8/2018 |
| WO | 2019180958 | A1 | 9/2019 |

OTHER PUBLICATIONS

Office Action of Counterpart Russian Patent application, RU 2020135287.
Extended European Search Report of Counterpart European Patent application, EP 20203415.3.
Office Action and translation for corresponding Indian Patent Appln. 202014048116 filed Nov. 4, 2020.

* cited by examiner

CASSETTE AND AUTOMATED TELLER MACHINE INCLUDING THE SAME

CROSS-REFERENCE TO RELATED APPLICATION

This application is based on and claims priority from Korean Patent Application No. 10-2019-0144586, filed on Nov. 12, 2019, the disclosure of which is incorporated herein in its entirety by reference for all purposes.

TECHNICAL FIELD

The present disclosure relates to a cassette and an automated teller machine including the same.

BACKGROUND

In general, an automated teller machine (ATM) is an automation device that can provide unmanned financial services such as cash/check deposits and withdrawals through the use of a card or a bankbook without bank employees regardless of time or place.

Recently, the use of automated teller machines has been expanding not only in financial institutions such as banks or the like but also in convenience stores, department stores and public places. The automated teller machines may be divided into a withdrawal machine, a deposit machine and a withdrawal/deposit machine depending on whether or not to deposit or withdraw money.

The automated teller machines have been used for various purposes such as cash deposit/withdrawal, check deposit/withdrawal, bankbook update, fee payment, ticket issuance and the like.

The configuration of such an automated teller machine will be briefly described. The automated teller machine includes a deposit/withdrawal part for a user to input or receive a medium for deposit or withdrawal, a conveyance path through which the medium deposited or withdrawn through the deposit/withdrawal part is conveyed, a discrimination part provided on the conveyance path to discriminate the presence or absence of an abnormality and the type of a medium, a temporary storage part in which the medium deposited through the discrimination part is temporarily stored, a rejected medium storage part configured to accommodate a medium discriminated by the discrimination part to have an abnormality, and a medium storage part configured to perform a reflux function so that the medium is received or withdrawn.

Recently, there has been proposed an automated teller machine that includes a plurality of medium storage parts in one cassette so as to cope with multiple types of media.

However, as described above, the conventional automated teller machine (e.g., Korean Patent Registration No. 10-1665609 (registered on Oct. 6, 2016)) provided the plurality of storage parts has a plurality of conveyance paths for conveying a paper medium to the plurality of storages parts. The conveyance paths may occupy a large space inside the cassette, which poses a problem that the overall size of the cassette needs to grow larger.

SUMMARY

Embodiments of the present disclosure provide a cassette and an automated teller machine including the same capable of saving the internal space of the cassette by allowing a plurality of conveyance paths to have independent conveyance routes inside the cassette wile occupying a minimum space.

In accordance with a first embodiment of the present disclosure, there is provided an automated teller machine, including: a cassette including a plurality of storage parts configured to store a paper medium, and a case having a plurality of entrances through which the paper medium passes to be accumulated in the storage parts or is withdrawn from the storage parts to pass; a strongbox protection wall covering the cassette and having an external entrance through which the paper medium passes to be loaded into the cassette or is unloaded from the cassette to pass; an external conveyance path extending to penetrate the strongbox protection wall through the external entrance; and a plurality of external branch conveyance paths extending between the external conveyance path and the entrances of the case, respectively.

The cassette may further include a plurality of internal conveyance paths provided to enable bi-directional conveyance of the paper medium between the entrances and the storage parts.

The internal conveyance paths may be configured to enable independent conveyance of the paper medium without communicating with each other or crossing each other.

The storage parts may include a first storage part disposed at an upper portion of the cassette, and a second storage part disposed at a lower portion of the cassette; the entrances include a first entrance and a second entrance disposed to be spaced apart from the first entrance; and the internal conveyance paths includes a first internal conveyance path configured to convey the paper medium between the first storage part and the first entrance, and a second internal conveyance path configured to convey the paper medium between the second storage part and the second entrance.

The external conveyance paths may include a first external branch conveyance path configured to convey the paper medium to the first internal conveyance path through the first entrance; and a second external branch conveyance path configured to convey the paper medium to the second internal conveyance path through the second entrance.

The first entrance may be formed on one portion of the case such that the first internal conveyance path and the first external branch conveyance path, which are connected to each other, pass through the first entrance, and the second entrance provided on another portion of the case such that the second internal conveyance path and the second external branch conveyance path, which are connected to each other, pass through the second entrance.

The second storage part may be disposed below the first storage part, and is configured to store the paper medium independently of the first storage part.

The second internal conveyance path may be provided so as not to interfere with the first internal conveyance path in the cassette, and extends toward the second storage part outside the first storage part.

The second entrance may be disposed closer to a peripheral edge of the case than the first entrance.

The automated teller machine further includes: a main body; and a main conveyance path provided inside the main body to provide a conveyance route for the paper medium, wherein the external conveyance path is configured to convey the paper medium between the main conveyance path and the external branch conveyance paths.

A portion of the main conveyance path may form a closed loop conveyance path configured to convey the paper medium along a route having a closed loop shape, and the external conveyance path may be branched from the closed loop conveyance path and pass through the external entrance.

The automated teller machine may further includes a discrimination part configured to discriminate the paper medium conveyed along the main conveyance path, wherein the external conveyance path is branched from a lower portion of the closed loop conveyance path, and the discrimination part is provided at an upper portion of the closed loop conveyance path.

In accordance with a second embodiment of the present disclosure, there is provided a cassette including: a plurality of storage parts configured to store a paper medium; a plurality of entrances through which the paper medium passes to be accumulated in the storage parts or is withdrawn from the storage parts to pass; and a plurality of internal conveyance paths provided to enable bi-directional conveyance of the paper medium between the entrances and the storage parts.

The cassette may further include: a case configured to form an outer shape of the cassette, wherein the entrances includes a first entrance and a second entrance formed on an upper surface of the case, the first entrance is disposed to be spaced apart from a peripheral edge of the case by a predetermined distance, and the second entrance is disposed to be spaced apart from the peripheral edge of the case by a distance shorter than the predetermined distance.

The entrances may be disposed to be biased toward one side of the case on the upper surface of the case.

The cassette may further include: an accumulation withdrawal operation part configured to perform an operation of accumulating the paper medium in the storage parts and an operation of withdrawing the paper medium from the storage parts, wherein the accumulation withdrawal operation part includes a plurality of accumulation withdrawal operation parts biased toward the one side of the case where the entrances are disposed.

In accordance with a third embodiment of the present disclosure, there is provided an automated teller machine for processing a paper medium at user's request, including: a cassette including a plurality of storage parts configured to store the paper medium, and a case having a plurality of entrances through which the paper medium passes to be accumulated in the storage parts or is withdrawn from the storage parts to pass; a cassette accommodation part configured to accommodate the cassette; a plurality of external branch conveyance paths extending from the entrances of the cassette; and a conveyance path support part configured to support the external branch conveyance paths and to open and close the cassette accommodation part by being rotated with respect to the cassette accommodation part.

The automated teller machine may further include a deposit/withdrawal part for a user to input the paper medium to the machine or to receive the paper medium from the machine; and an external conveyance path configured to convey the paper medium between the deposit/withdrawal part and the external branch conveyance paths, wherein the external conveyance path is supported by the conveyance path support part.

The automated teller machine may further include: a cassette accommodation part configured to provide a space for accommodating the cassette; and a conveyance path support part configured to support the external conveyance path and the external branch conveyance paths and configured to open and close the cassette accommodation part so that the cassette is selectively exposed to the outside.

The automated teller machine may further include: an actuator provided in the conveyance path support part to generate a driving force for loading and unloading the paper medium into and from the storage parts; and an accumulation withdrawal operation part provided in the cassette to receive the driving force generated by the actuator to perform an operation of accumulating the paper medium in the storage parts and an operation of withdrawing the paper medium from the storage parts.

According to the embodiments of the present disclosure, the conveyance paths are defined so as to occupy a minimum space in the cassette. Therefore, the internal space of the cassette is saved, which makes it possible to provide an automated teller machine having a compact size.

In addition, the internal conveyance paths are connected through independent conveyance routes without any mutually sharing section inside the cassette. Therefore, there is an advantage that the internal conveyance paths can be independently used without being influenced by each other. Accordingly, even when a jam of a paper medium occurs in any one of the internal conveyance paths, the remaining internal conveyance paths can be used normally.

DETAILED DESCRIPTION

Figure 1:
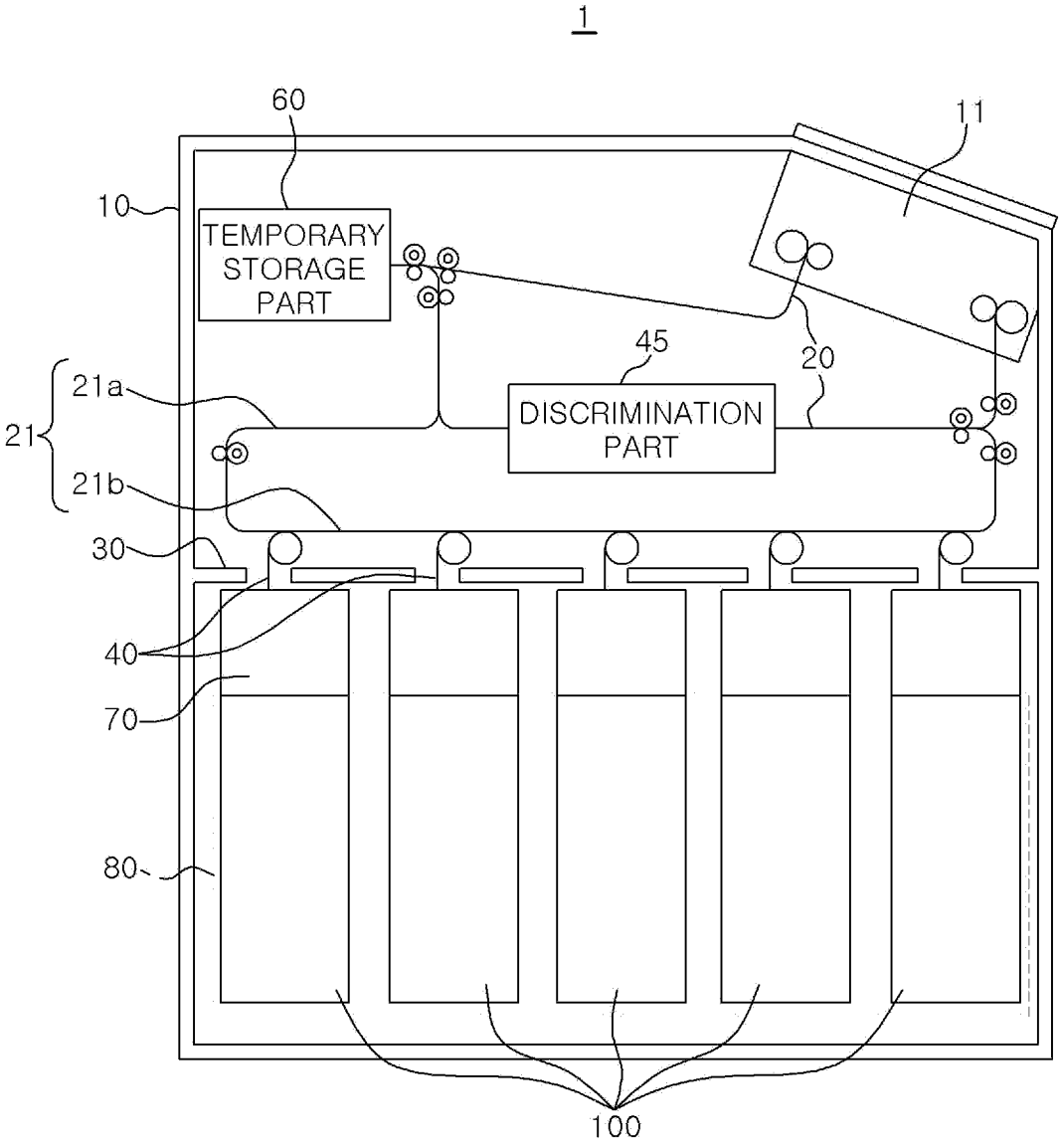
FIG. 1 is a side view schematically showing the configuration of an automated teller machine according to an embodiment of the present disclosure.

Hereinafter, configurations and operations of embodiments will be described in detail with reference to the accompanying drawings. The following description is one of various patentable aspects of the disclosure and may form a part of the detailed description of the disclosure.

In describing the embodiments of the present disclosure, the detailed descriptions of well-known functions or configurations will be omitted if it is determined that the detailed descriptions of well-known functions or configurations may unnecessarily make obscure the spirit of the present disclosure.

The disclosure may be variously modified and may include various embodiments. Specific embodiments will be exemplarily illustrated in the drawings and described in the detailed description of the embodiments. However, it should be understood that they are not intended to limit the disclosure to specific embodiments but rather to cover all modifications, similarities, and alternatives which are included in the spirit and scope of the disclosure.

The terms used herein, including ordinal numbers such as "first" and "second" may be used to describe, and not to limit, various components. The terms simply distinguish the components from one another.

When it is said that a component is "connected" or "linked" to another component, it should be understood that the former component may be directly connected or linked to the latter component or a third component may be interposed between the two components.

Specific terms in the present disclosure are used simply to describe specific embodiments without limiting the present disclosure. An expression used in the singular encompasses the expression of the plural, unless it has a clearly different meaning in the context.

Hereinafter, an embodiment of the present disclosure will be described in detail with reference to the accompanying drawings.

Figure 2:
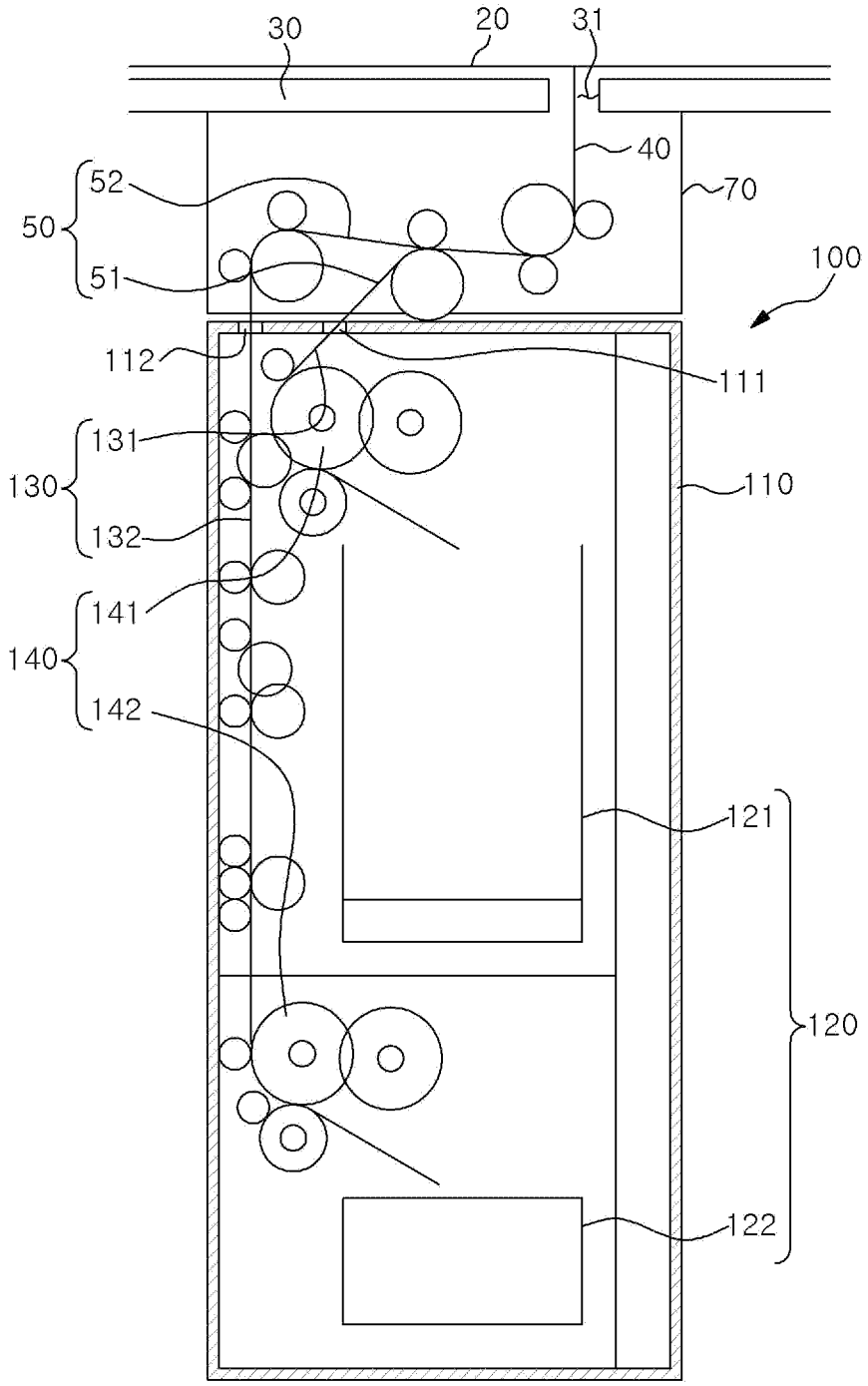
FIG. 2 is an enlarged view showing a main configuration and a side surface of structure of the automated teller machine according to the embodiment of the present disclosure.

Referring to FIGS. 1 and 2, the automated teller machine 1 according to an embodiment of the present disclosure includes a main body 10, a main conveyance path 20, a cassette 100, a strongbox protection wall 30, an external conveyance path 40, a discrimination part 45, an external branch conveyance path 50, a temporary storage part 60, a conveyance path support part 70, and a cassette accommodation part 80.

The expression "includes (including) the above-listed components" in the embodiment of the present disclosure does not mean that the embodiment of the present disclosure consists of only these components, but means that the embodiment of the present disclosure basically includes these components. The embodiment of the present disclosure may further include other components (components well-known in the field of the automated teller machine). However, the well-known components will not be described in detail because such a description may obscure the gist of the present disclosure.

The main body 10 may provide a storage space for storing a paper medium. In this embodiment, the main body 10 is not limited to the storage space of the paper medium (a bank note, a check, etc.). The main body 10 may include a housing for defining the overall appearance of the automated teller machine 1 and a frame for supporting internal components.

The main body 10 may be provided with a deposit/withdrawal part 11. The deposit/withdrawal part 11 may provide a deposit/withdrawal space for a user to input or receive a paper medium. The deposit/withdrawal part 11 may be provided with belts, roller, motors and the like for conveying the paper medium. The configurations of the belts, the rollers, the motors and the like are general matters in the conveyance of a paper medium. Therefore, the detailed descriptions thereof are omitted.

The main conveyance path 20 provides a conveyance route of the paper medium deposited or withdrawn through the deposit/withdrawal part 11 and may be provided in the internal space of the main body 10. A portion of the main conveyance path 20 may form a closed loop conveyance path 21 configured to convey the paper medium along a route having a closed loop shape in a side view. The discrimination part 45 may be provided at an upper portion 21*a* of the closed loop conveyance path 21. A plurality of external conveyance paths 40 may be connected to a lower portion 21*b* of the closed loop conveyance path 21.

For example, the main conveyance path 20 may guide the paper medium deposited through the deposit/withdrawal part 11 to the discrimination part 45, the temporary storage part for temporarily storing the paper medium, and the cassette 100. The main conveyance path 20 may guide the paper medium discharged from the cassette 100 to the discrimination unit 45 and the deposit/withdrawal part 11.

The cassette 100 may provide a stacking space so that the paper medium can be loaded into and unloaded from the cassette 100. The cassette 100 may include a plurality of storage parts having different sizes depending on the type of medium. The cassette 100 may be configured to be selectively removed from the main body 10.

Referring to FIG. 2, the cassette 100 may include a case 110, a plurality of storage parts 120, a plurality of internal conveyance paths 130, and a plurality of accumulation withdrawal operation parts 140.

The case 110 is provided so that a paper medium can be loaded into the case 110, and may be a cassette of the automated teller machine 1. The case 110 may have a predetermined loading space formed therein. The loading space may be divided into a plurality of loading spaces as necessary. The case 110 may be configured to be detachably attached to the automated teller machine 1. The case 110 may form an external shape of the cassette 100.

The case 110 may be provided with entrances 111 and 112 through which the paper medium to be accumulated in and withdrawn from the storage parts 120 passes. The entrances 111 and 112 may include a first entrance 111 and a second entrance 112, and may further include additional entrances as needed.

The first entrance 111 is formed on an upper surface of the case 110, and may be provided so that a first internal conveyance path 131 and a first external branch conveyance path 51, which will be described later, can be connected to each other through the first entrance 111. The first entrance 111 may be disposed at a position biased to one side from the center of the case 110. For example, when viewed from the side, the first entrance 111 may be disposed at a position biased toward a first accumulation withdrawal operation part 141. As a more detailed example, when the first accumulation withdrawal operation part 141 is disposed at a rear of the cassette 100 in a side view, the first entrance 111 may be disposed at a rearward biased position on the upper surface of the cassette 100.

In addition, the second entrance 112 is formed on the upper surface of the case 110 so that a second internal conveyance path 132 and a second external branch conveyance path 52, which will be described later, can be connected to each other through the second entrance 112. As such, the first entrance 111 and the second entrance 112 may be formed in the case 110 so that a plurality of conveyance routes extends from the outside of the case 110 to the inside thereof.

The second entrance 112 may be disposed at a position biased toward a second accumulation withdrawal operation part 142 from the center of the case 110. As a more detailed example, when the second accumulation withdrawal operation part 142 is disposed at the rear of the cassette 100 in a side view, the second entrance 112 may be disposed at a rearward biased position on the upper surface of the cassette 100. Furthermore, the second entrance 112 may be disposed closer to the peripheral edge of the case 110 than the first entrance 111. Accordingly, a predetermined separation distance between the second entrance 112 and the edge of the case 110 may be shorter than a predetermined separation distance between the first entrance 111 and the edge of the case 110. In other words, the second entrance 112 may be disposed farther away from the center of the case 110 than the first entrance 111.

The storage parts 120 are disposed inside the case 110 along the accumulation direction of the paper medium. The storage parts 120 may be installed in order to independently receive each of the paper media inside the case 110. The storage parts 120 may be arranged to be spaced apart from each other in the vertical direction inside the case 110. However, the present disclosure is not limited thereto. The storage parts 120 may be spaced from each other in the transverse direction inside the case 110 as needed.

In this regard, the storage parts 120 may include a first storage part 121 and a second storage part 122, and may further include additional storage parts as necessary.

The first storage part 121 may be disposed in the upper portion of the case 110 as illustrated in FIG. 2. A predetermined accommodation space may be provided inside the first storage part 121 so as to store a paper medium.

In addition, the second storage part 122 may be located in the lower portion of the case 110, i.e., below the first storage part 121. Just like the first storage part 121, a predetermined accommodation space may be provided inside the second storage part 122 so as to store a paper medium.

Meanwhile, the internal conveyance paths 130 may be provided and disposed so as to be independently operable such that the internal conveyance paths 130 do not communicate with each other inside the case 110. The internal conveyance paths 130 may be configured to convey a paper medium in both directions.

The internal conveyance paths 130 may be connected to the external branch conveyance paths 50, which will be described later, to perform independent bidirectional conveyance of a paper medium for each of the storage parts 120.

Specifically, the internal conveyance paths 130 may include the first internal conveyance path 131 and the second internal conveyance path 132, and may further include an additional internal conveyance path as necessary.

The first internal conveyance path 131 may be configured to convey a paper medium between the first storage unit 121 and the first entrance 111. In addition, the first internal conveyance path 131 is provided to connect the first external branch conveyance path 51 and the first storage part 121 through the first entrance 111 of the case 110 so that a paper medium can be introduced into or withdrawn from the first storage part 121.

The second internal conveyance path 132 may be configured to convey the paper medium between the second storage part 122 and the second entrance 112. In addition, the second internal conveyance path 132 is provided to introduce or withdraw the paper medium by connecting the second external branch conveyance paths 52 and the second storage part 122 through the second entrance 112 of the case 110.

The second internal conveyance path 132 does not communicate (i.e., does not share any section) with the first internal conveyance path 131 inside the case 110. Therefore, even if a jam occurs in the first internal conveyance path 131, the second internal conveyance path 132 can be operated normally.

The second internal conveyance path 132 may be disposed outside the first internal conveyance path 131 (on the left side of the first internal conveyance path 131 in the drawing) so as not to interfere with the first internal conveyance path 131 in the case 110. The second internal conveyance path 132 may extend from the second entrance 112 formed on the upper surface of the case 110 to the second storage part 122 while passing by the first storage part 121.

The accumulation withdrawal operation parts 140 may be driven to accumulate media in the storage parts 120 or to unload the media out of the storage parts 120. In addition, each of the accumulation withdrawal operation parts 140 may include a rotating shaft and a guide. Each of the accumulation withdrawal operation parts 140 may include the first accumulation withdrawal operation part 141 provided in the first storage part 121 to accumulate a medium in the first storage part 121 and unload the medium from the first storage part 121, and the second accumulation withdrawal operation part 142 provided in the second storage part 122 to accumulate a medium in the second storage part 122 and unload the medium from the second storage part 122. In addition, each of the accumulation withdrawal operation parts 140 may be driven by receiving power from an actuator such as a motor or the like. The actuator for driving each of the accumulation withdrawal operation parts 140 may be provided outside the cassette 100. For example, the actuator may be disposed on the conveyance path support part 70, and may drive the accumulation withdrawal operation parts 140 by transmitting its driving force to each of the accumulation withdrawal operation parts 140 through power transmission elements (not shown) such as a drive shaft, a gear and the like. Since the actuator is provided outside the cassette 100 in this way, the weight of the cassette 100 is reduced. This makes it possible to improve the handling convenience and portability of the cassette 100.

In addition, the strongbox protection wall 30 is formed integrally with the main body 10 or formed to extend from the main body 10, and may form a portion of the main body 10 in some cases. The strongbox protection wall 30 may be provided to cover the cassette 100 by being spaced apart from at least one side surface (e.g., an upper surface) of the cassette 100. The strongbox protection wall 30 may be made of a very strong and sturdy material to protect the cassette 100 from the outside. A strongbox entrance portion 31 may be formed in the strongbox protection wall 30 as shown in FIG. 2.

As illustrated in FIG. 2, the strongbox entrance portion 31 may be formed in an opening form so that the external conveyance path 40 to be described later can pass through the strongbox entrance portion 31. The strongbox entrance portion 31 may allow passage of a paper medium loaded into or unloaded from the cassette 100. In addition, a plurality of strongbox entrance portions 31 may be provided. One strongbox entrance portion 31 may be provided in a corresponding relationship with one cassette 100.

In addition, the external conveyance path 40 is connected to the main conveyance path 20 provided on the upper side thereof to receive or transfer the paper medium. The external conveyance path 40 is a conveyance path provided outside the case 110 of the cassette 100, and may extend from the outside of the strongbox protection wall 30 to the inside of the strongbox protection wall 30 through the strongbox entrance portion 31. The external conveyance path 40 may mean a conveyance path disposed between the main conveyance path 20 and the external branch conveyance path 50 to be described later.

The discrimination part 45 may detect the type and abnormality of the paper medium conveyed along the main conveyance path 20. The discrimination part 45 may be provided at the upper portion 21*a* of the closed loop conveyance path 21.

On the other hand, the external branch conveyance paths 50 are provided in a plural number, and are branched from the external conveyance path 40 extending into the strongbox protection wall 30 through the strongbox entrance portion 31. The external branch conveyance paths 50 may communicate with the entrances 111 and 112 provided in the cassette 100, respectively. In other words, the external branch conveyance paths 50 may extend from the entrances 111 and 112. The external branch conveyance paths 50 may extend between the external conveyance path 40 and the entrances of the cassette 100.

Each of the external branch conveyance paths 50 may include a first external branch conveyance path 51 and a second external branch conveyance path 52 and may further include additional external branch conveyance paths as necessary.

The first external branch conveyance path 51 may connect the external conveyance path 40 and one portion of the case 110 (the first entrance 111) so that a paper medium can be loaded into and unloaded from the first storage part 121.

The second external branch conveyance path 52 may connect the external conveyance path 40 and another portion of the case 110 (the second entrance 112) so that a paper medium can be loaded into and unloaded from the second storage part 122.

The temporary storage part 60 may temporarily store the paper media discriminated by the discrimination part 45 during a depositing/counting process, and may unload the temporarily stored paper media to the main conveyance path 20 in a depositing/storing process.

The conveyance path support part 70 may be a frame for supporting the external conveyance paths 40 and the external branch conveyance paths 50. The conveyance path support part 70 may be connected to the strongbox protection wall 30 and may be opened together with the strongbox protection wall 30 when the strongbox protection wall 30 is opened. The conveyance path support part 70 may form a region distinguished from the cassette 100, and may be configured to make contact with the upper surface of the cassette 100 disposed in the cassette accommodation part 80.

The conveyance path support part 70 may be configured to open and close the cassette accommodation part 80. In addition, the conveyance path support part 70 may be opened or closed by a hinge 71 and a locker 72. The hinge 71 may be provided so that the conveyance path support part 70 is rotatable with respect to the cassette accommodation part 80, and the locker 72 may prevent the conveyance path support part 70 from being opened arbitrarily with respect to the cassette accommodation part 80. In other words, the conveyance path support part 70 may be rotated about the hinge 71 in a state in which the locker 72 is released, thereby opening the cassette accommodation part 80 and selectively exposing the cassette 100. In addition, the conveyance path support part 70 may be rotated about the hinge 71 so that the locker 72 is engaged, thereby closing the cassette accommodation part 80 and preventing the cassette 100 from being exposed. The locker 72 can prevent the conveyance path support part 70 from being opened arbitrarily with respect to the cassette accommodation part 80.

The cassette accommodation part 80 may provide a space for accommodating at least one cassette 100. The cassette accommodation part 80 may be provided at the lower portion of the automated teller machine 1, and the upper side thereof may be opened by the conveyance path support part 70. The teller may take out or insert the cassette 100 through the open upper side of the cassette accommodation part 80.

As described above, in the automated teller machine 1 according to an embodiment of the present disclosure, as shown in FIG. 2, the external branch conveyance paths 50 branched from one external conveyance path 40 are connected to the internal conveyance paths 130 so that the external branch conveyance paths 50 can have independent internal conveyance routes without being influenced by each other inside the case 110. Accordingly, even if a jam occurs in any one internal conveyance paths 130 inside the case 110, the remaining internal conveyance paths 130 may operate normally.

Hereinafter, the operation of the automated teller machine according to the present disclosure will be described with reference to FIGS. 3 and 4.

Figure 3:
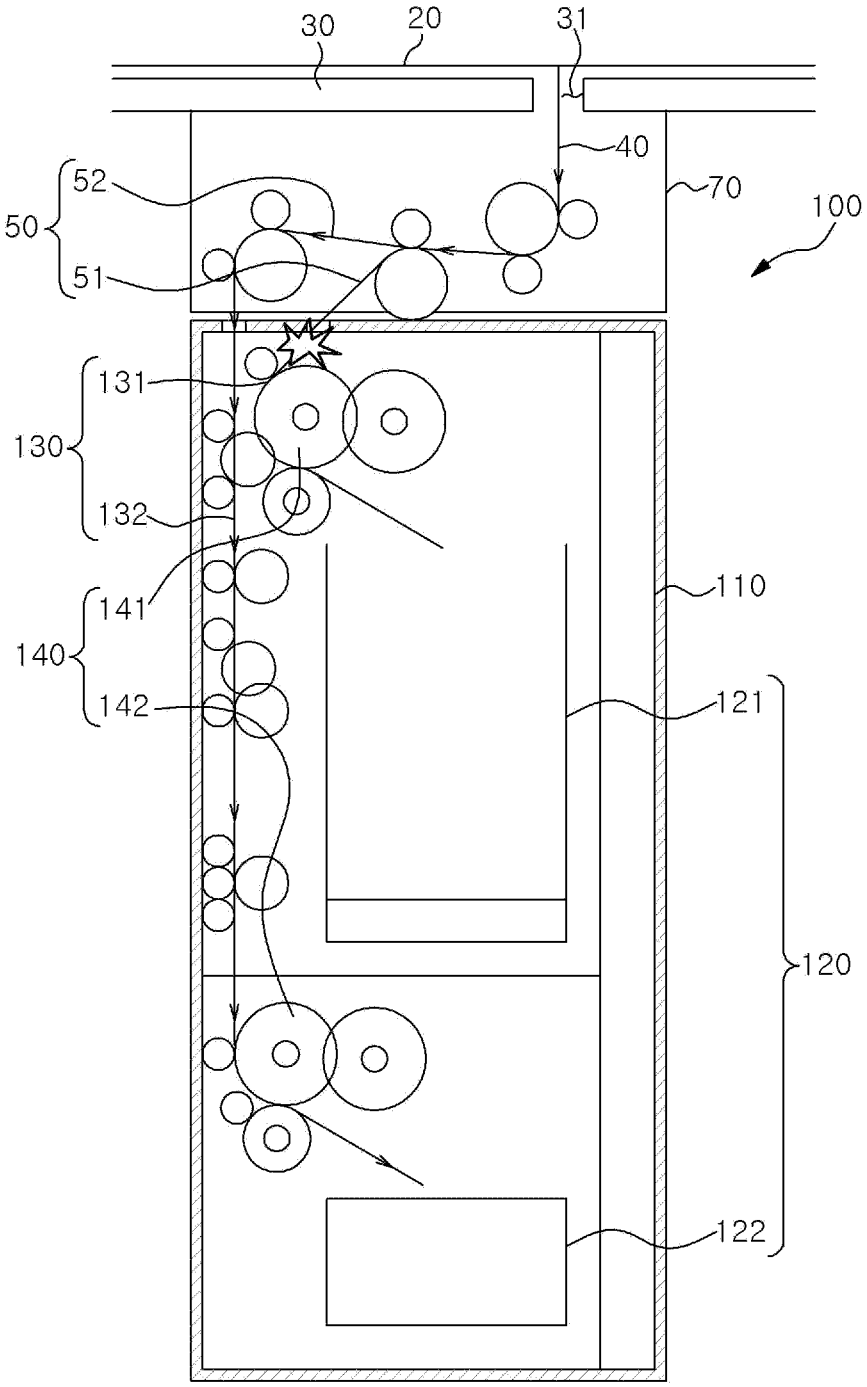
FIG. 3 is a side reference view showing a situation in which a second internal conveyance path is operating normally when a jam occurs in a first internal conveyance path.

Referring to FIG. 3, when a jam of a paper medium occurs in any one of the internal conveyance paths 130, e.g., in the first internal conveyance path 131, the second internal conveyance path 132 can be operated normally independently of the first internal conveyance path 131. Therefore, the paper medium can be normally conveyed without being affected by the jam of the paper medium in the first internal conveyance path 131.

Figure 4:
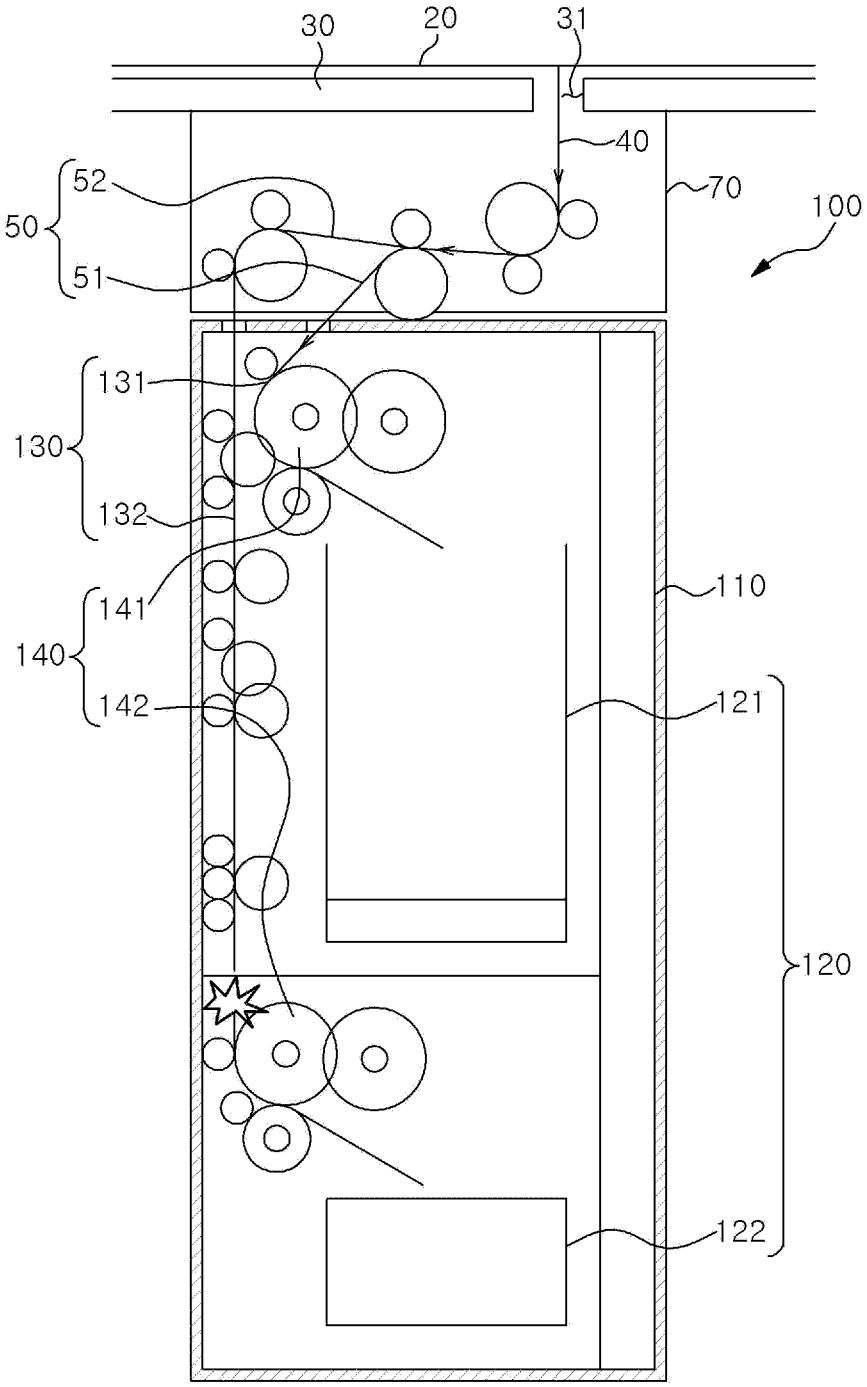
FIG. 4 is a side reference view showing a situation in which the first internal conveyance path is operating normally when a jam occurs in the second internal conveyance path.
Figure 5:
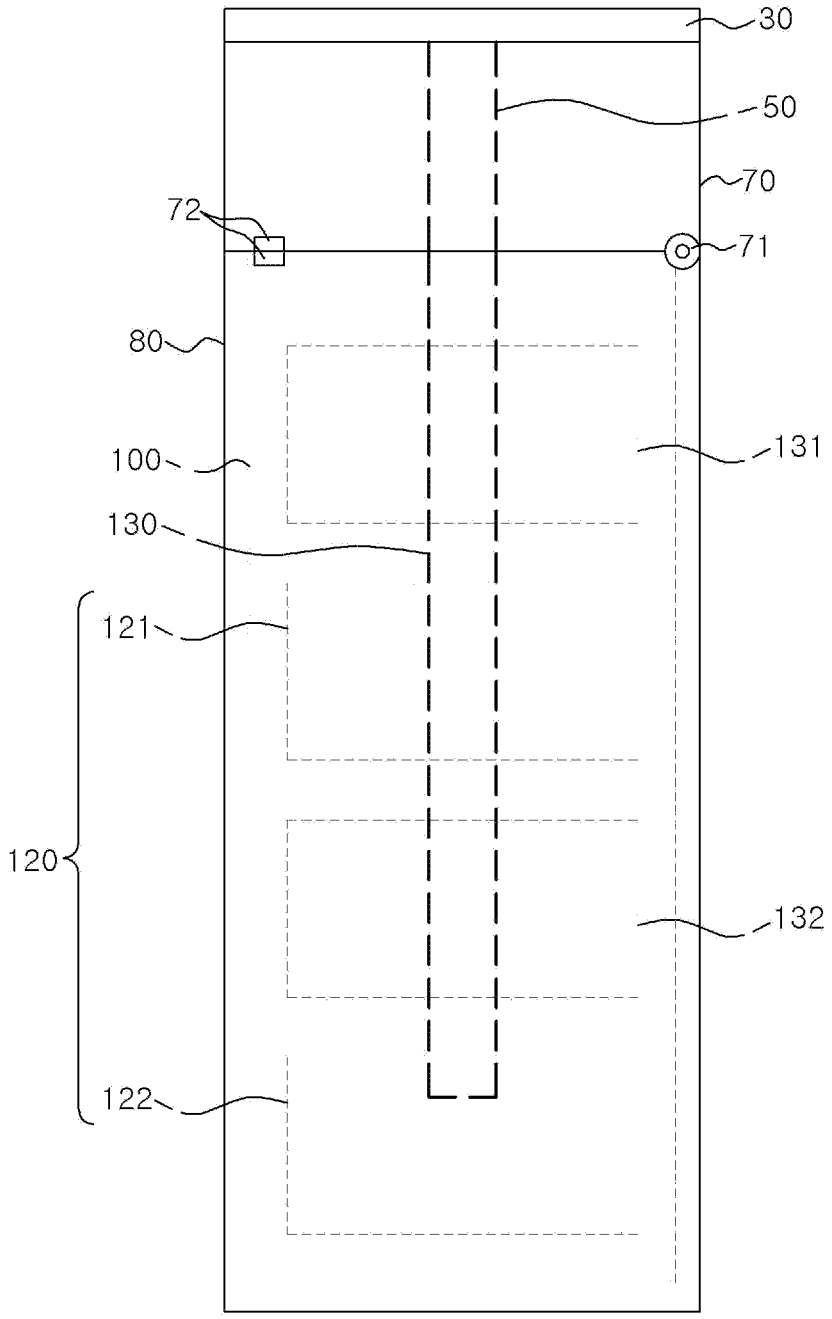
FIG. 5 is a front view of the interior of the automated teller machine of FIG. 1, which conceptually shows that a conveyance path support part is closed with respect to a cassette accommodation part.
Figure 6:
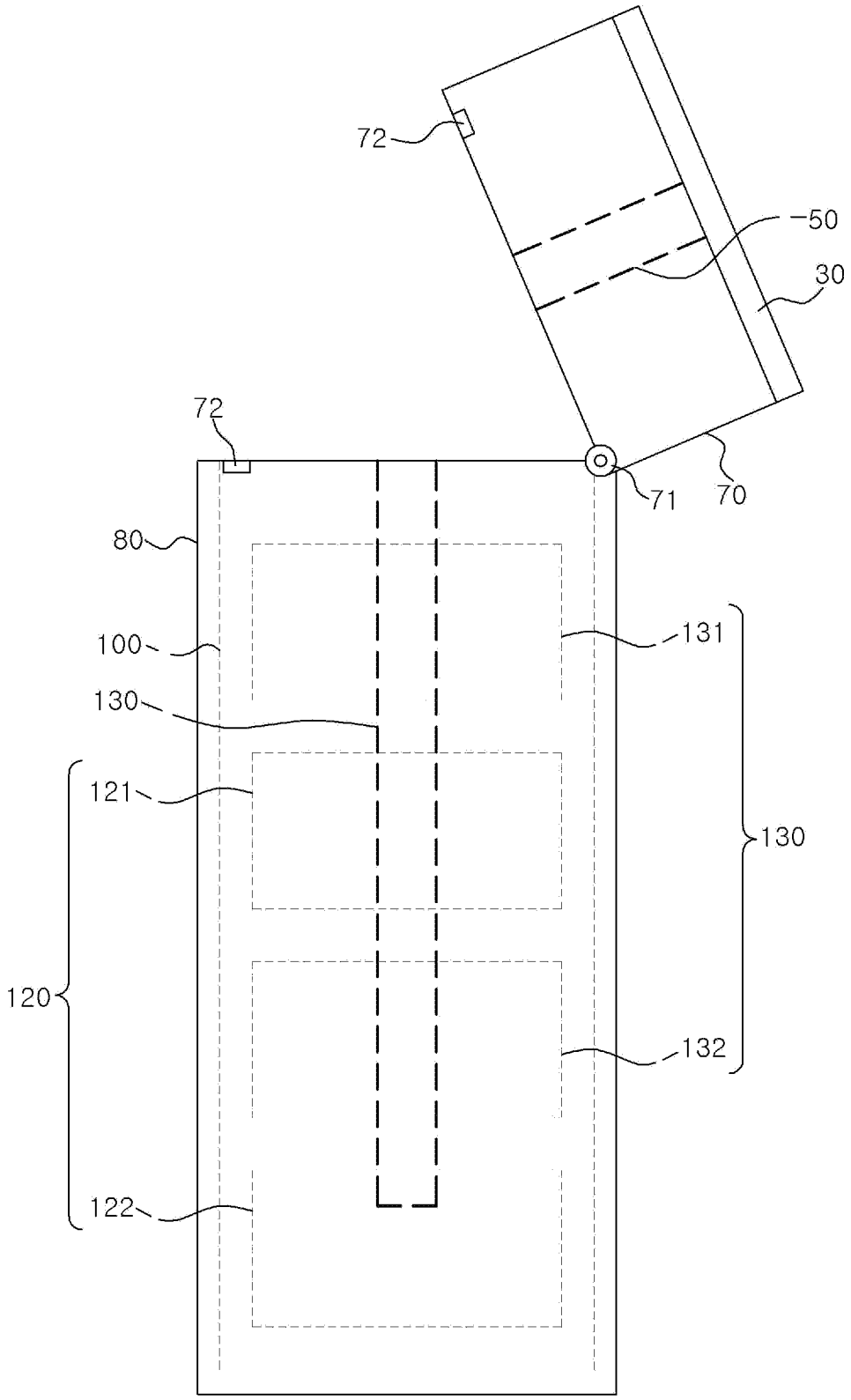
FIG. 6 is a front view conceptually showing that the conveyance path support part of FIG. 5 is closed with respect to the cassette accommodation part.

In addition, as shown in FIG. 4, even when the jam of the paper medium occurs in the second internal conveyance path 132, the first internal conveyance path 131 can be independently operated from the second internal conveyance path 132. Therefore, the paper medium can be normally conveyed without being affected by the jam of the paper medium in the second internal conveyance path 132.

While the present disclosure has been described above using the preferred embodiments, the scope of the present disclosure is not limited to the specific embodiments described above. A person having ordinary knowledge in the relevant technical field will be able to replace or modify the constituent elements. Such replacement or modification should be construed to fall within the scope of the present disclosure.

What is claimed is:

1. An automated teller machine, comprising:

a main body;

a plurality of cassettes, wherein each of the plurality of cassettes includes: a plurality of storage parts configured to store a paper medium, and a case having a plurality of entrances through which the paper medium passes to be accumulated in the plurality of storage parts or is withdrawn from the plurality of storage parts to pass;

a strongbox protection wall covering the plurality of cassettes and having an external entrance through which the paper medium passes to be loaded into the plurality of cassettes or is unloaded from the plurality of cassettes to pass;

an external conveyance path extending to penetrate the strongbox protection wall through the external entrance;

a plurality of external branch conveyance paths extending between the external conveyance path and the plurality of entrances of the case, respectively;

a cassette accommodation part configured to provide a space for accommodating the plurality of cassettes;

a conveyance path support part configured to support the external conveyance path and the plurality of external branch conveyance paths and configured to open and close the cassette accommodation part so that the plurality of cassettes are selectively exposed to the outside;

an actuator provided in the conveyance path support part to generate a driving force for loading and unloading the paper medium into and from the plurality of storage parts;

an accumulation withdrawal operation part provided in each of the plurality of cassettes to receive the driving force generated by the actuator to perform an operation of accumulating the paper medium in the plurality of storage parts and an operation of withdrawing the paper medium from the plurality of storage parts;

a main conveyance path provided inside the main body to provide a conveyance route for the paper medium; and a discrimination part configured to discriminate the paper medium conveyed along the main conveyance path, wherein the external conveyance path is configured to convey the paper medium between the main conveyance path and the plurality of external branch conveyance paths, wherein a portion of the main conveyance path forms a closed loop conveyance path configured to convey the paper medium along a route having a closed loop shape, and wherein the discrimination part is provided at an upper portion of the closed loop conveyance path, wherein each of the plurality of cassettes further includes a plurality of internal conveyance paths provided to enable bi-directional conveyance of the paper medium between the plurality of entrances and the plurality of storage parts, wherein the plurality of internal conveyance paths are configured to enable independent conveyance of the paper medium without communicating with each other or crossing each other, wherein each of the plurality of storage parts include a first storage part disposed at an upper portion of the corresponding cassette, and a second storage part disposed at a lower portion of the corresponding cassette;

the plurality of entrances are formed on an upper surface of the case, and include a first entrance and a second entrance disposed to be spaced apart from the first entrance; and the plurality of internal conveyance paths includes a first internal conveyance path configured to convey the paper medium between the first storage part and the first entrance, and a second internal conveyance path configured to convey the paper medium between the second storage part and the second entrance, and wherein the paper medium accumulated in the first storage part and the paper medium accumulated in the second storage part are independently conveyed to the discrimination part along the main conveyance path.

2. The automated teller machine of claim 1, wherein the plurality of external branch conveyance paths includes a first external branch conveyance path configured to convey the paper medium to the first internal conveyance path through the first entrance; and a second external branch conveyance path configured to convey the paper medium to the second internal conveyance path through the second entrance.

3. The automated teller machine of claim 2, wherein the first entrance is formed on one portion of the case such that the first internal conveyance path and the first external branch conveyance path, which are connected to each other, pass through the first entrance, and the second entrance provided on another portion of the case such that the second internal conveyance path and the second external branch conveyance path, which are connected to each other, pass through the second entrance.

4. The automated teller machine of claim 1, wherein the second internal conveyance path is provided so as not to interfere with the first internal conveyance path in the cassette, and extends toward the second storage part outside the first storage part.

5. The automated teller machine of claim 1, wherein the second entrance is disposed closer to a peripheral edge of the case than the first entrance.

6. The automated teller machine of claim 1, wherein the plurality of external branch conveyance paths branch from the closed loop conveyance path and passes through the external entrance.

7. The automated teller machine of claim 6, wherein the external conveyance path is branched from a lower portion of the closed loop conveyance path.

8. The automated teller machine of claim 1, wherein the case is configured to form an outer shape of the cassette, the first entrance is disposed to be spaced apart from a peripheral edge of the case by a predetermined distance, and the second entrance is disposed to be spaced apart from the peripheral edge of the case by a distance shorter than the predetermined distance.

9. The automated teller machine of claim 8, wherein the plurality of entrances are disposed to be biased toward one side of the case on the upper surface of the case.

10. The automated teller machine of claim 9, wherein the accumulation withdrawal operation part includes a plurality of accumulation withdrawal operation parts biased toward the one side of the case where the plurality of entrances are disposed.

11. An automated teller machine for processing a paper medium at user's request, comprising:

a main body;

a plurality of cassettes, wherein each of the plurality of cassettes includes: a plurality of storage parts configured to store the paper medium, and a case having a plurality of entrances through which the paper medium passes to be accumulated in the storage parts or is withdrawn from the plurality of storage parts to pass;

a cassette accommodation part configured to accommodate the plurality of cassettes;

a plurality of external branch conveyance paths extending from the plurality of entrances of the plurality of cassettes;

a conveyance path support part configured to support the plurality of external branch conveyance paths and to open and close the cassette accommodation part by being rotated with respect to the cassette accommodation part;

a deposit/withdrawal part for a user to input the paper medium to the automated teller machine or to receive the paper medium from the automated teller machine;

an external conveyance path configured to convey the paper medium between the deposit/withdrawal part and the plurality of external branch conveyance paths, wherein the external conveyance path is supported by the conveyance path support part;

an actuator provided in the conveyance path support part to generate a driving force for loading and unloading the paper medium into and from the plurality of storage parts;

an accumulation withdrawal operation part provided in each of the plurality of cassettes to receive the driving force generated by the actuator to perform an operation of accumulating the paper medium in the plurality of storage parts and an operation of withdrawing the paper medium from the plurality of storage parts;

a main conveyance path provided inside the main body to provide a conveyance route for the paper medium; and a discrimination part configured to discriminate the paper medium conveyed along the main conveyance path, wherein the external conveyance path is configured to convey the paper medium between the main conveyance path and the plurality of external branch conveyance paths, wherein a portion of the main conveyance path forms a closed loop conveyance path configured to convey the paper medium along a route having a closed loop shape, and wherein the discrimination part is provided at an upper portion of the closed loop conveyance path, wherein each of the plurality of cassettes further includes a plurality of internal conveyance paths provided to enable bi-directional conveyance of the paper medium between the plurality of entrances and the plurality of storage parts, wherein the plurality of internal conveyance paths are configured to enable independent conveyance of the paper medium without communicating with each other or crossing each other, wherein each of the plurality of storage parts include a first storage part disposed at an upper portion of the corresponding cassette, and a second storage part disposed at a lower portion of the corresponding cassette;

the plurality of entrances are formed on an upper surface of the case, and include a first entrance and a second entrance disposed to be spaced apart from the first entrance; and the plurality of internal conveyance paths includes a first internal conveyance path configured to convey the paper medium between the first storage part and the first entrance, and a second internal conveyance path configured to convey the paper medium between the second storage part and the second entrance, and wherein the paper medium accumulated in the first storage part and the paper medium accumulated in the second storage part are independently conveyed to the discrimination part along the main conveyance path.

* * * * *